US005752406A

United States Patent [19]

Dearing et al.

[11] Patent Number: 5,752,406

[45] Date of Patent: May 19, 1998

[54] FLEXIBLE COINING DIE

[76] Inventors: James Michael Dearing, 747 Tindle Bay Rd., RR #2, Peterborough, Ontario, Canada, K9J 6X3; Ronald Stewart Barclay, 549 King Street, Peterborough, Ontario, Canada, K9J 2T4

[21] Appl. No.: 739,127

[22] Filed: Oct. 28, 1996

[51] Int. Cl.[6] ..... B21D 5/01

[52] U.S. Cl. ..... 72/389.1; 72/387; 72/465

[58] Field of Search ..... 72/344, 387, 388, 72/465, 389.1

[56] References Cited

U.S. PATENT DOCUMENTS

| | | | |
|---|---|---|---|
| 3,276,239 | 10/1966 | Achler et al. | 72/465 |
| 3,444,716 | 5/1969 | Martin | 72/465 |
| 4,295,352 | 10/1981 | Stokes et al. | 72/465 |
| 5,099,675 | 3/1992 | Heath | 72/465 |
| 5,353,622 | 10/1994 | Theener | 72/387 |
| 5,365,766 | 11/1994 | Takahashi et al. | 72/387 |

FOREIGN PATENT DOCUMENTS

| | | | |
|---|---|---|---|
| 2522882 | 12/1975 | Germany | 72/465 |
| 1342576 | 10/1987 | U.S.S.R. | 72/465 |
| 2050887 | 1/1981 | United Kingdom | 72/387 |

*Primary Examiner*—David Jones
*Attorney, Agent, or Firm*—Edward H. Oldham

[57] ABSTRACT

A flexible coining die for producing elongated bearing pads of a predetermined radius for use in nuclear reactors. The die is provided with a longitudinal groove having predetermined shape extending across the die. The die is supported by a block which will allow the die to bend at the groove so that the groove effectively "pinches" a bearing pad placed in the groove to be shaped during a coining operation. When the punch is withdrawn, the die returns to its undeflected shape and no longer "pinches" the bearing pad. The pad may be easily removed from the die.

7 Claims, 2 Drawing Sheets

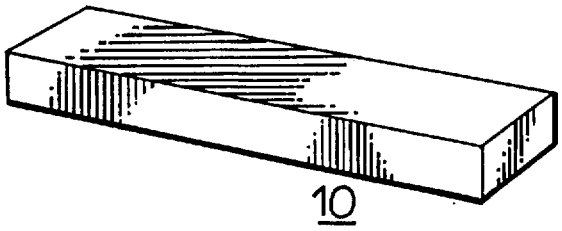
FIG. 1a.
(PRIOR ART)
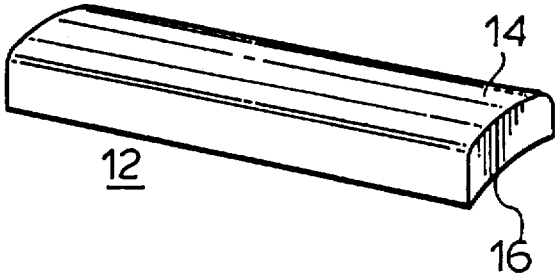
FIG. 1b.
(PRIOR ART)
FIG. 2.
(PRIOR ART)
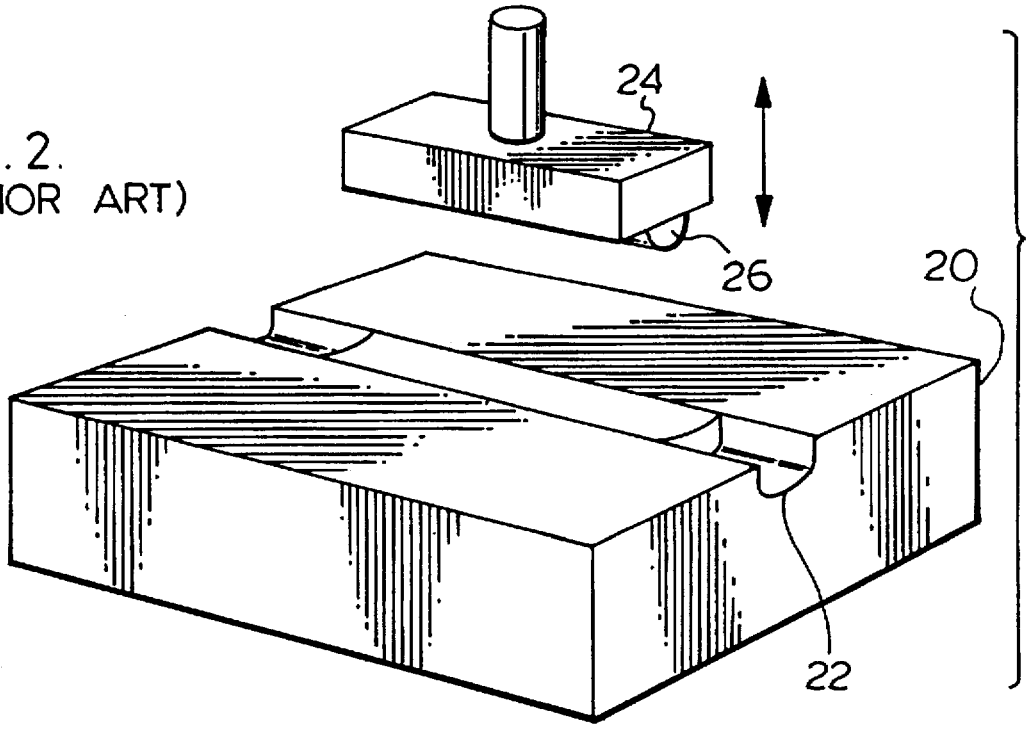

FLEXIBLE COINING DIE

BACKGROUND OF THE INVENTION

This invention relates to the shaping of zirconium alloy bearing pads for fuel bundles of nuclear reactors. Such bearing pads must be manufactured to very exacting specifications so as to have very precise shape when the manufacture of the pad is completed. Because of the demands of the purchasers of fuel bundles of nuclear reactors, the material forming the bearing pad must be a zirconium alloy. The pad must have a finished surface, length, width, and depth so as to comply with very precise specifications and the cross-sectional profile must be produced within very demanding tolerances.

Because of its peculiar characteristics, the zirconium alloy does not lend itself to shaping by grinding, or filing, thus if the shape of a zirconium article is to be changed, it will usually be found that, rolling, pressing or coining will be the desirable methods to change the shape.

In the past, spacers of zirconium alloy have been traditionally produced by shearing pieces from sheets of the zirconium material. This produces a bearing pad blank having the shape of a right parallelepiped. The blank is placed in a die having a depression in its surface of a shape which corresponds to the final outer shape of the bearing pad. A coining punch having a profile of the inner shape of the finished product is pressed against the blank to cause the material of the blank to flow to conform to the shape of the die and the punch. It is possible to shape the zirconium alloy in the apparatus previously described, but when the punch is withdrawn experience has shown that the newly formed bearing pad has a tendency to stick to the depression, and it may take considerable time to remove the blank from the die. It is to overcome this problem that this invention is directed.

SUMMARY OF THE INVENTION

This invention relates to a flexible die useful in producing shaped bearing pads for fuel bundles. The die of this invention has a groove in the upper surface thereof extending across the die. The die is supported on a base that provides support under the die along two planes which are spaced equal distances on either side of the groove in the upper surface. The material forming the die is of such thickness that it is weakened significantly at the longitudinally extending groove, so that when a blank is placed in the groove of the die, and a punch is pressed against it, the die tends to bend at the groove so that the two sides of the groove press inwardly as the die deforms to allow that part of the die housing the groove to drop slightly in its supporting structure. At this time, the die is supported by the aforementioned parallel supporting surfaces and a surface slightly below the parallel surfaces located under the groove in the die.

When the coining punch is withdrawn, the die springs back to its undeformed position and the edges of the groove retract slightly allowing the newly shaped blank to be released from the groove.

BRIEF DESCRIPTION OF THE DRAWINGS

FIG. 1*a* illustrates a perspective view of a zirconium alloy blank;

FIG. 1*b* shows a perspective view of a coined bearing pad produced from the blank of FIG. 1*a;*

FIG. 2 shows a perspective of a prior art punch and die for forming finished bearing pads;

DESCRIPTION OF THE PREFERRED EMBODIMENT

Figure 3:
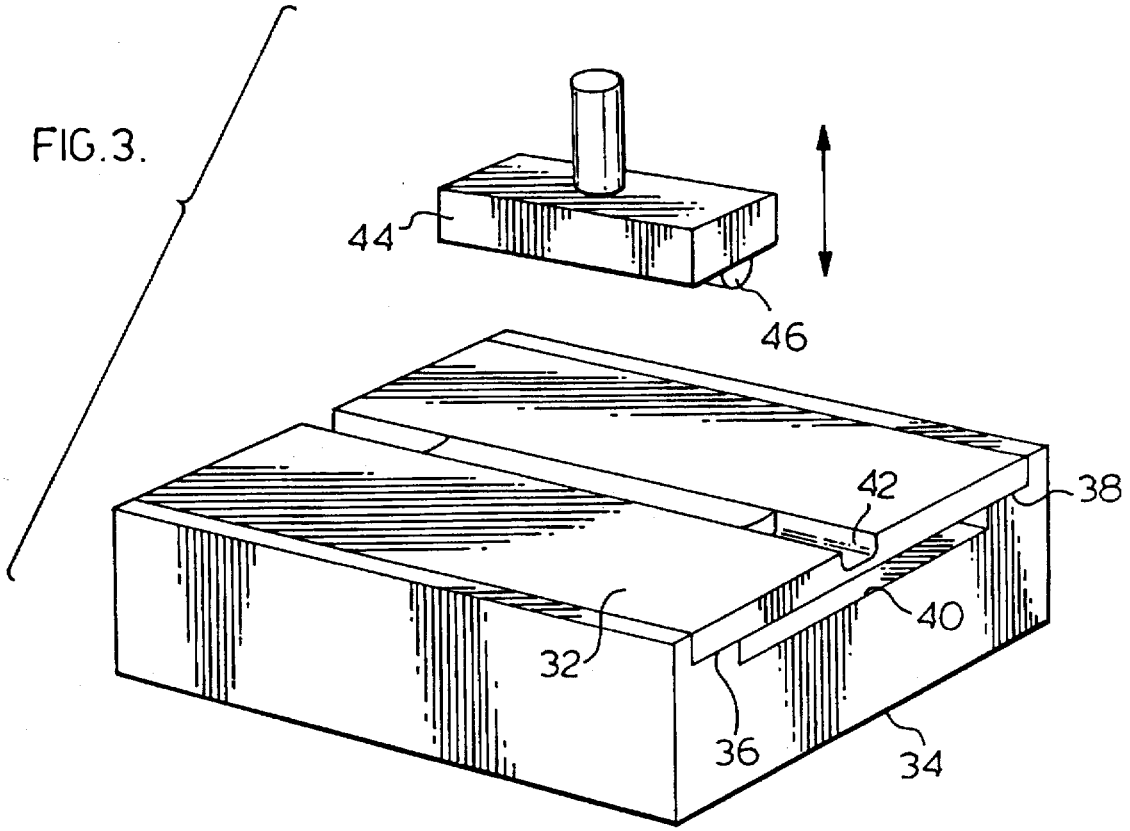
FIG. 3 shows a perspective of the apparatus of this invention.

Referring to FIG. 1*a* in a blank 10 of an unshaped bearing pad for a fuel bundle of a nuclear reactor is shown.

FIG. 1*b* shows a bearing pad 12 having its top and bottom surfaces formed (from blank 10) by a coining operation. In this instance, the top surface 14 curved to conform to very precise specifications. The lower surface 16 is also curved to exacting specifications as well.

This bearing pad forming operation has traditionally been accomplished by traditional apparatus as shown in FIG. 2. In this instance, a heavy die 20 is shown formed of tool steel. Die 20 has a precisely shaped groove 22 in the upper surface thereof where a blank such as 10 is placed. A punch 24 having a shaped projection 26 is punched against die 20 at the point where blank 10 lies in groove 22. The blank 10 undergoes cold flow during the punching operation, and when the punch is withdrawn, the newly formed blank will generally be "stuck" in groove 22. Various techniques have been employed to remove the formed bearing pad from the groove 22. Damage to the newly formed bearing pad may occur during the removal operation.

FIG. 3 shows the apparatus 30 of this invention. Shown here is a die sheet 32 supported on heavy block 34. Block 34 is shaped to have a pair of co-planar surfaces 36 and 38 at the extremities of the top surface of block 34. A depression 40 is formed in block 34 between surfaces 36 and 38.

A groove 42 is formed at the center of die sheet 32 so as to be parallel to and evenly spaced from surfaces 36 and 38. A blank such as 10 is placed in groove 42.

Punch 44 having a curved lower punching surface 46 is forced against the blank 10 in groove 42. As the punching surface advances, the die sheet 32 deflects to engage surface 40. Most of the distortion on die sheet 32 occurs at its weakest point, i.e. the groove 42. At the time that die sheet 32 is deformed (FIG. 4*b*), the sides 48 and 50 will deflect inwardly to "pinch" the blank undergoing forming.

Figure 4A:
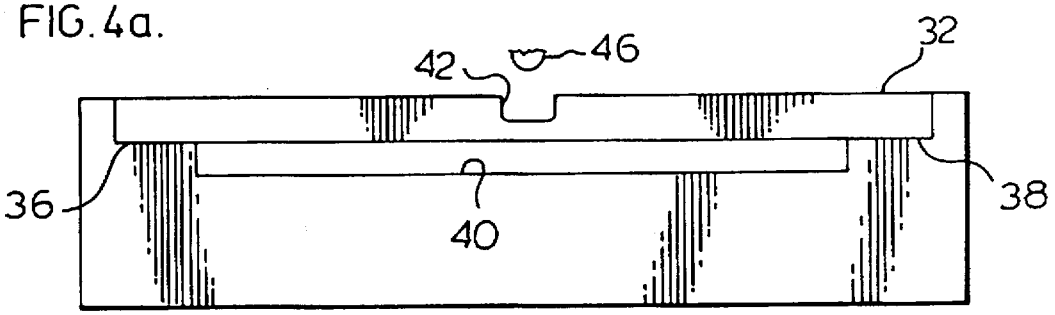
FIG. 4*a* shows the die apparatus of this invention in its undeformed state.
Figure 4B:
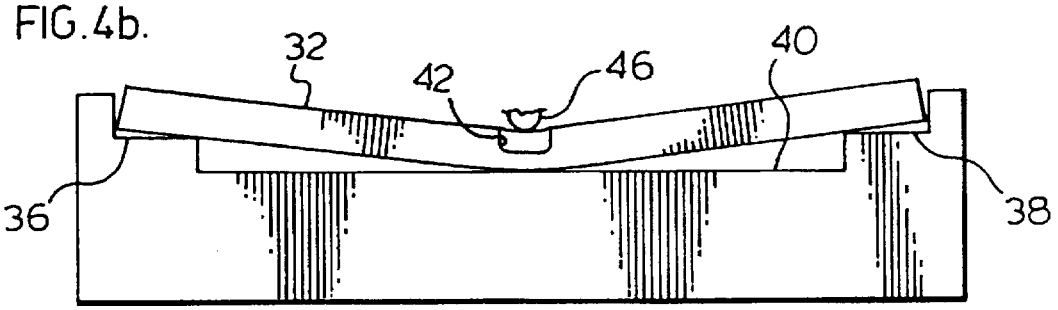
FIG. 4*b* shows the die apparatus of this invention in its deformed state.

As the punch 44 is retracted, the die sheet 32 returns to its original undeformed shape as shown in FIG. 4*a* and the sides 48 and 50 of the groove 42 separate slightly and allow the formed bearing pad such as 12 to be easily removed from the die sheet 32.

The peculiar shape of the finished bearing pads 12 is dictated by the utility purchasing the product. This means that the manufacturer of the bearing pads must take great care to produce the precise corner radii demanded by the purchaser. The smaller the radii of the corners of the bearing pads, the more difficult it becomes to remove the coined bearing pad from the prior art die.

It is not possible to make use of any lubricating agent in the production of zirconium alloy bearing pads because of possible contamination of the zirconium alloy metal.

The use of push rods to push the coined bearing pads from the die groove would probably provide a solution to the ejection problem, but the possible damage to the surface of the bearing pad prevents adoption of this practise.

It is believed that the process described above will find wide application in the coining industry and materials other than zirconium alloy may be shaped by this process.

It will be obvious to those skilled in the art that the tool steel forming the die may not be stressed to its yield point, or deformation or fracture of the die will result.

Heat treatment of the die may be utilized to add toughness to the die and extend the life of the die.

While alternatives are possible, applicant wishes to limit the scope of protection to the following claims.

We claim:

1. Die apparatus for producing a predetermined controlled deformation of a blank comprising a support member in the form of a block for supporting a substantially flat rectangularly shaped metallic die sheet on a pair of spaced apart co-planar surfaces at the top thereof, said metallic die sheet having a groove of a predetermined profile extending across said die sheet in the upper surface midway between a first pair of opposing sides of said metallic sheet thereof, said block supporting said metallic die sheet at said first pair of opposing sides at the outside edges thereof said block having second upper surface formed therein and extending between said pair of co-planar surfaces, said second surface being spaced slightly below said pair of co-planar surfaces.

2. Apparatus as claimed in claim 1 wherein said die sheet is resilently deformable at said groove.

3. A method of producing a controlled deformation of a blank comprising:

providing a punch having a forming head of a predetermined shape providing a metallic die in the form of a substantially flat sheet having a groove of predetermined profile extending across the center of said sheet, supporting said sheet on a pair of co-planar surfaces evenly spaced from said groove, placing a blank of predetermined dimensions in said groove, moving said punch into engagement with said blank and pressing said blank in said groove to deflect said die sheet at said groove to slightly displace said sheet and said groove to a predetermined position slightly below its undeflected position producing a controlled deformation of said blank in said groove, retracting said punch from said bearing pad and allowing said die sheet to return to its undeformed state removing said formed bearing pad from said die sheet.

4. A method as claimed in claim 3 wherein said die sheet provided is tool steel and wherein the die sheet is deflected with its elastic limit.

5. A method as claimed in claim 3 providing a second support surface slightly below said pair of co-planar surfaces so as to limit the deflection of said sheet to its predetermined position.

6. A method as claimed in claim 3 wherein said die sheet is deflected within its elastic limit.

7. A method as claimed in claim 3 wherein said punch is subsequently retracted from said blank permitting said sheet to return to its undeflected position to release said blank.

* * * * *